US011277679B1

(12) United States Patent
Lagler et al.

(10) Patent No.: US 11,277,679 B1
(45) Date of Patent: Mar. 15, 2022

(54) HEADPHONE EARCUP STRUCTURE

(71) Applicant: Apple Inc., Cupertino, CA (US)

(72) Inventors: Jarrett B. Lagler, San Francisco, CA (US); Michael B. Minerbi, San Francisco, CA (US); Miikka O. Tikander, Helsinki (FI); Lee M. Panecki, Los Gatos, CA (US); Trang Fisher, San José, CA (US); Esge Andersen, Campbell, CA (US); Eugene Whang, San Francisco, CA (US); Ben Shaffer, San Jose, CA (US); Edward Siahaan, San Francisco, CA (US); Daniel R. Bloom, Alameda, CA (US); Kitty Yung, San Francisco, CA (US); Tyler A. Green, San Jose, CA (US); Krithika Elangovan, Freemont, CA (US); Sarah Gysbers, Santa Clara, CA (US); Michael Burello, Vaughan (CA); Matthew Zaverl, San Francisco, CA (US); Christopher A. Sandieson, Santa Clara, CA (US); Casey L. Baran, Glassport, PA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/023,246

(22) Filed: Sep. 16, 2020

(51) Int. Cl.
*H04R 1/10* (2006.01)

(52) U.S. Cl.
CPC ..... *H04R 1/1008* (2013.01); *H04R 1/1075* (2013.01); *H04R 1/1083* (2013.01); *H04R 2400/11* (2013.01)

(58) Field of Classification Search
CPC ..... H04R 1/10; H04R 1/1008; H04R 1/1058; H04R 1/1075; H04R 1/1083; H04R 2201/10; H04R 2400/11
See application file for complete search history.

(56) References Cited

U.S. PATENT DOCUMENTS

| | | | | |
|---|---|---|---|---|
| 6,597,792 | B1 | 7/2003 | Sapiejewski et al. | |
| 8,374,373 | B2 | 2/2013 | Sapiejewski et al. | |
| 9,807,493 | B1 | 10/2017 | Willis et al. | |
| 2010/0119076 | A1 | 5/2010 | Monk et al. | |
| 2011/0216909 | A1* | 9/2011 | Sapiejewski ..... | H04R 1/1008 381/71.6 |
| 2019/0149904 | A1* | 5/2019 | England ..... | H04R 5/033 381/371 |
| 2021/0112326 | A1* | 4/2021 | Bogan ..... | H04R 1/1008 |

* cited by examiner

*Primary Examiner* — Thang V Tran
(74) *Attorney, Agent, or Firm* — Womble Bond Dickinson (US) LLP

(57) ABSTRACT

A headphone earcup including a frame defining a cavity dimensioned to surround an ear of a user; a damping component coupled to the frame and encircling the cavity; a wrap component that covers the damping component and defines a continuous acoustic opening around the cavity to acoustically connect the cavity to the damping component; and a cosmetic component that covers the wrap component and the continuous acoustic opening.

19 Claims, 6 Drawing Sheets

HEADPHONE EARCUP STRUCTURE

FIELD

An embodiment of the invention is directed to a headphone earcup structure, more specifically a headphone earcup cushion having a multi-part structure with improved acoustic performance. Other embodiments are also described and claimed.

BACKGROUND

Whether listening to a portable media player while traveling, or to a stereo or theater system at home, consumers often choose headphones. Headphones typically include a pair of earcups which encircle the user's ears and are held together by a headband. Headphones can be classified into two general categories based on the design of the earcups, namely closed-back or open-back earcups. Closed-back earcups surround the user's ears and have a sealed back. Open-back earcups also surround the user's ears but have a back which is open to the ambient environment surrounding the earcup.

Both the closed-back and the open-back designs have their own acoustic advantages and disadvantages. For example, closed-back earcups may have good sound isolation since they are sealed off from ambient noise. In addition, the size and clamp force of the earcups may also be modified to further increase sound isolation. Features of the closed-back design, such as the sealed back, size and clamp force of the earcups allow this design to mechanically or passively attenuate ambient noise. Due to the closed design of closed-back earcups, however, they may have stronger resonances. For example, standing waves can accumulate in the earcups. These standing waves can degrade sound quality and reduce the feeling of openness, which is often desired by a user. Open-back earcups, however, may not be ideal in noisy environments because their passive attenuation may not be as good as closed-back designs.

SUMMARY

An aspect of the invention may include a headphone configuration in which the earcups include a particular damping structure, interior structure and cover configuration to improve earcup performance by, for example, damping standing waves without interfering with earcup comfort. For example, each earcup may include a donut or annular shaped structure or cushion that encircles the driver facing the user's ear to cushion and/or seal the earcup against the user's ear and/or head. The donut or annular shaped structure may be made up of a number of components, for example, a damping component (e.g., a foam), an interior support structure or wrap (e.g., a silicone layer) surrounding the damping component and a cosmetic cover (e.g., a textile layer) surrounding the damping component and the interior structure or wrap.

In some aspects, the damping component may be foam that forms the innermost part of the earcup cushion. The foam may help cushion the earcup against the user's ear/head. In addition, the foam may have acoustic impedance values that specifically change sound to damp out the standing wave within the earcup chamber or cavity surrounding the user's ear.

In some aspects, the interior support structure or wrap may be a layer of acoustically opaque material that wraps around the damping component (e.g., foam) and include an opening or gap exposing the foam to the acoustic cavity surrounding the user's ear. The term "acoustically opaque material" is intended to refer to a material that does not generally allow sound to pass through it. Examples of an acoustically opaque material may include, but are not limited to, a silicone, a polyurethane (PU), or thermal polyurethane (TPU) material. An opening or gap is further provided so that sound from within the earcup cavity may still reach the foam when it is enclosed by the wrap. The opening or gap may encircle the side of the damping component (e.g., foam) that faces the ear and be continuous along the entire inner perimeter of the damping component and cavity. The opening is at a particular location and of a particular size and/or shape so that it remains open and allows a minimum amount of damping when the cushion is compressed against the user's ear/head. In addition, the wrap may be thicker toward the outer side of the cushion (e.g., exterior side facing away from the ear/head) and decease in thickness (e.g., get thinner) toward the inner side of the cushion (e.g., interior side facing toward the ear/head). Having a maximum thickness of wrap on the exterior/outer side (e.g., furthest away from the user's ear/head) helps with passive attenuation, while minimizing the thickness on interior/inner side (e.g., where the cushion contacts the ear/head) helps with sealing of the earcup to the user's ear/head. In some aspects, the wrap may be overmolded to the earcup frame.

The cosmetic cover may cover both the wrap and the opening or gap. The cosmetic cover may be made of a cosmetically opaque material so that the earcup cushion does not include any visible openings. The term "cosmetically opaque" is intended to refer to a material that prevents a user from seeing any openings, gaps or other aspects of the underlying layer(s). The material of the cosmetic cover may also be acoustically transparent so that acoustic waves can pass through the cover (and the gap in the wrap) to the foam for damping. The term "acoustically transparent" is intended to refer to a material that allows sound to pass through it. Representatively, the cosmetic cover may be made of a textile material that is cosmetically opaque and acoustically transparent. The material of the cosmetic cover may also help with sealing of the earcup cushion to the user's ear/head.

Representatively, in one aspect, a headphone earcup includes a frame defining a cavity dimensioned to surround an ear of a user; a damping component coupled to the frame and encircling the cavity; a wrap component that covers the damping component and defines a continuous acoustic opening around the cavity to acoustically connect the cavity to the damping component; and a cosmetic component that covers the wrap component and the continuous acoustic opening. The wrap component may include a variable thickness. The wrap component may include an outer edge that is over molded to the frame and an inner edge that defines the continuous acoustic opening. The wrap component may be thicker near the outer edge than the inner edge. The continuous acoustic opening may extend around an entire perimeter of the cavity. In some aspects, an entire area of the continuous acoustic opening remains open when the headphone earcup is compressed. The wrap component may include a material selected from one of a silicone, a polyurethane or a thermal polyurethane. The cosmetic component may include an acoustically transparent and cosmetically opaque material.

In another aspect, a headphone earcup may include a frame defining an acoustic cavity that is acoustically coupled to a driver; and an annular cushion coupled to the frame and encircling the acoustic cavity, the annular cushion comprising a damping component and an interior support member partially covering the damping component, the interior support member having a variable thickness. In some aspects, the variable thickness of the interior support member increases in a direction away from the acoustic cavity. In some aspects, the interior support member defines a continuous acoustic opening between the acoustic cavity and the damping component to acoustically connect the damping component to the acoustic cavity. The continuous acoustic opening may be configured to remain open during compression of the annular cushion so as to maximize an acoustic clamping under compression. The damping component may include a foam material and the interior support member comprises a silicone material. The interior support member may include a silicone material over molded to the frame. The earcup may further include a cosmetic layer covering the interior support member and the damping component to form a cosmetic surface free of visible openings. The cosmetic layer may include a textile material.

In another aspect, a headphone earcup may include a frame defining an acoustic cavity that is acoustically coupled to a driver; and a cushion coupled to the frame and encircling the acoustic cavity, the cushion comprising an interior support member having an outer edge coupled to the frame and an inner edge that defines an annular gap between the interior support member and the frame, and wherein a thickness of the interior support member decreases in a direction toward the inner edge. The outer edge of the interior support member may be overmolded to the frame. The annular gap may completely encircle the acoustic cavity. The interior support member may include an apex at a position furthest from the frame, and the thickness of the interior support member begins to decrease between the apex and the inner edge.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred aspects with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some aspects may be practiced without these details. In other instances, well-known structures and techniques have not been shown in detail so as not to obscure the understanding of this description.

Figure 1:
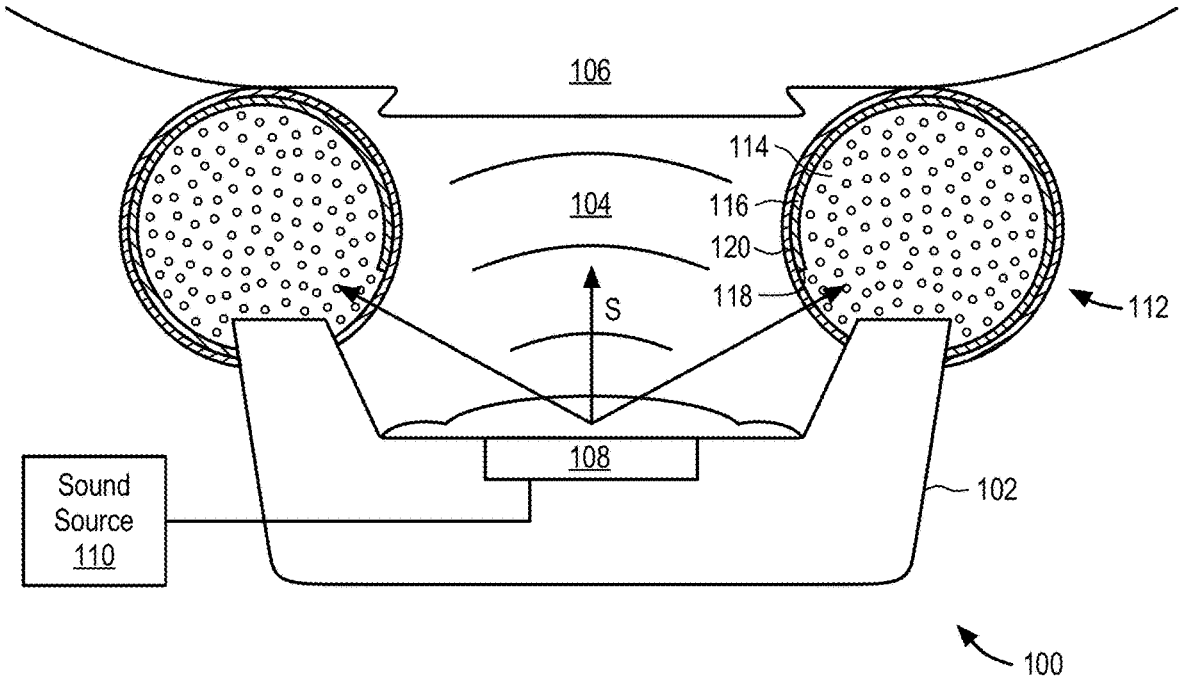
FIG. 1 illustrates a schematic diagram of a cross-sectional view of one aspect of a headphone earcup structure.

FIG. 1 illustrates a schematic diagram of a cross-sectional view of one aspect of a headphone earcup structure. It should be understood that the figures illustrate only one of a pair of left and right ear earcups of headphone 100, which can be connected by a head band (not shown). Thus, each of the features described in reference to the earcup of headphone 100 illustrated in FIG. 1 should be understood as applying to the other earcup of headphone 100. The earcup of headphone 100 includes a frame 102 that forms an enclosure dimensioned to encircle and form an acoustic cavity 104 around a user's ear 106. Acoustic cavity 104 may surround the ear 106 when the earcup of headphone 100 is positioned on the user's head.

A driver 108 for outputting sound (S) (e.g., a music signal) in a direction of ear 106 may be mounted to frame 102. Driver 108 may be any type of electric-to-acoustic transducer having a pressure sensitive diaphragm and circuitry configured to produce a sound in response to an electrical audio signal input (e.g., a loudspeaker). The electrical audio signal may be a music signal input to driver 108 by sound source 110. Sound source 110 may be any type of audio device capable of outputting an audio signal, for example, an audio electronic device such as a smartphone, a portable music player, home stereo system or home theater system capable of outputting an audio signal.

The earcup of headphone 100 may further include an earcup pad or cushion 112. The earcup cushion 112 may be attached to a side or face of frame 102 facing the ear 106 and forming the acoustic cavity 104. In some cases, the earcup cushion 112 may form part of the acoustic cavity 104 and help to form a seal between the acoustic cavity 104 and the user's ear 106. The earcup cushion 112 may be a donut or otherwise similarly circular, race track or elliptical shaped structure that encircles the acoustic cavity 104 and can seal around, or to, the head or ear 106 of the user. The earcup cushion 112 may be compressible and conform to the head and/or ear 106 of the user when pressed against the user's head and/or ear to improve user comfort.

In addition to helping cushion the earcup against the user's head and/or ear 106, the earcup cushion 112 may be configured to improve an acoustic performance of the earcup. For example, the cushion 112 may be configured to address anti-resonances which may undesirably impact acoustic performance. Anti-resonances within the earcup can cause a number of issues including a loss of high frequency resolution, tonal imbalance, a narrowing of stereo image and/or a more reverberant high frequency sound signature. The earcup cushion 112 may be configured to optimize acoustic damping to address anti-resonances. Representatively, earcup cushion 112 may include a damping component 114 and an interior support member 116 that wraps partially around the damping component 114. The damping component 114 may help to dampen standing waves. The interior support member 116 may provide rigidity and structure to the cushion 112 and further help improve acoustic performance and/or sealing. In some aspects, earcup cushion 112 may further include a cosmetic cover 120 which completely encases all the underlying earcup cushion 112 components so the earcup 112 has one continuous surface with no opening or other non-cosmetic features visible to the user.

Figure 2:
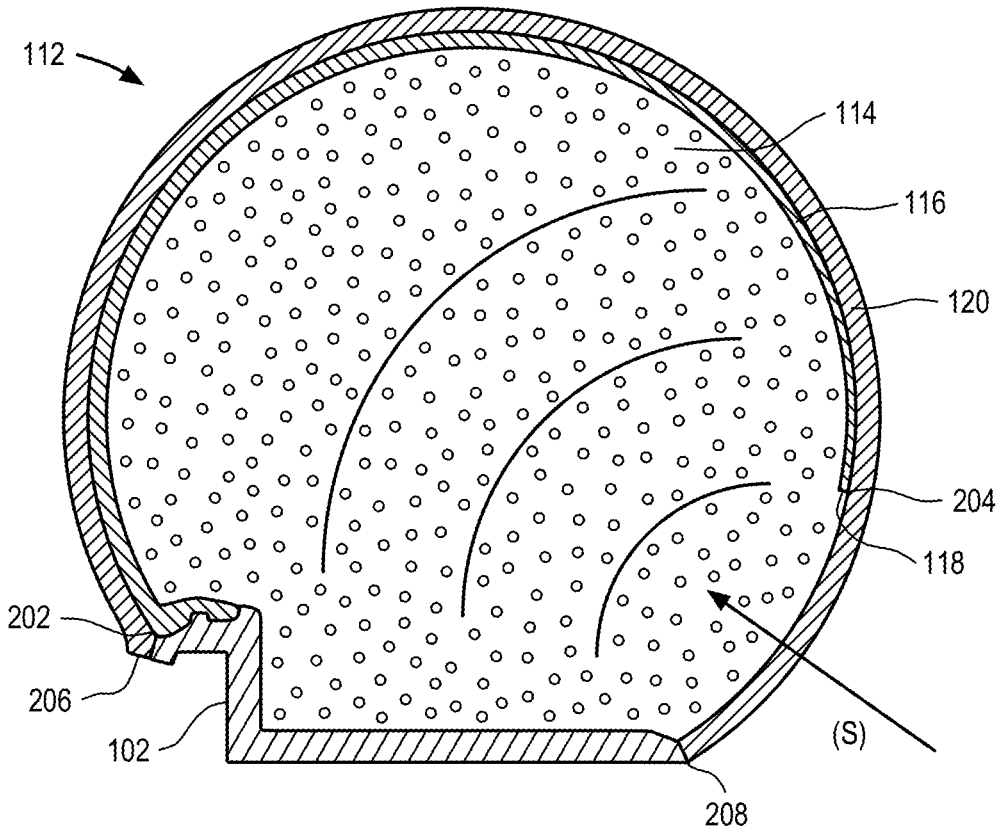
FIG. 2 illustrates a schematic diagram of a magnified cross-sectional view of the headphone earcup structure of FIG. 1.

Specific aspects of each of the components of the earcup cushion 112 will now be described in more detail in reference to FIG. 2. In particular, FIG. 2 illustrates a schematic diagram of a magnified cross-sectional view of the earcup cushion 112 of FIG. 1. From this view, it can be seen that the cushion structure includes the damping component 114, interior support member 116 and cosmetic cover 120 attached to the frame 102. The damping component 114 may form the inner most structure of the cushion 112 and have an annular or donut like shape that encircles the user's ear when in use. The damping component 114 may be, for example, an acoustically transparent material such as a foam material. The foam material may be any foam material that is acoustically transparent and may have acoustic impedance values that specifically change sound to dampen out the standing wave. In addition to having damping properties, the foam may compress to help cushion and seal the earcup cushion 112 against the user's head or ear 106.

The interior support member 116 may be wrapped, or otherwise formed, around the damping component 114. The interior support member 116 may be made of an acoustically opaque material that can provide structural rigidity and passive attenuation to the earcup. For example, the interior support member 116 may be made of an acoustically opaque material such as a silicone, a polyurethane (PU) or thermal polyurethane (TPU). Representatively, the interior support member 116 may be a silicone wrap or solid sheet like structure that is wrapped at least partially around the outer surface of the damping component 114. In order to allow sound (S) to still pass from the acoustic cavity 104 to the damping component 114, a gap or opening 118 may be formed between the interior support member 116 and the frame 102. For example, the interior support member 116 may have one side or edge 202 that is attached to the frame 102 and another side or edge 204 that forms the gap or opening 118 to the damping component 114. The side or edge 202 may be overmolded to the frame 102 and then the remainder of the support member 116 is wrapped around damping component 114 toward the cavity 104. For example, the frame 102 may be formed from a polycarbonate (PC) material and then the support member 116 may be cured/molded onto the frame 102. The side or edge 202 may be considered an exterior or outer side or edge in that it is farthest away from, or facing away from, the cavity 104. The side or edge 204 may be considered an interior or inner side or edge in that it is closest to, or facing toward, the cavity 104. The side or edge 204 stops short of the interior or inner side of the frame 102 to form the gap or opening 118 so that sound can pass between the cavity 104 and the damping component 114. The opening 118 may be formed at a specific location around a perimeter of cavity 104 and have a specific size/shape found to improve damping and provide a consistent seal. In addition, the interior support member 116 may have a particular structure, for example a variable thickness, found suitable for maintaining the desired opening 118 size and/or shape under compression and providing passive attenuation. The structure of the interior support member 116 and associated opening 118 which help to improve acoustic performance will be discussed in more detail in reference to FIGS. 3-5.

The cosmetic cover 120 may be made of an acoustically transparent material so that sound may pass through opening 118. The cosmetic cover 120 may also be cosmetically opaque so that there are no visible openings in the earcup cushion 112. In some aspects, earcup cushion 112 may further include a cosmetic cover 120 which completely encases the interior support member 116 and opening 118. The cosmetic cover 120 may be made of an acoustically transparent material so that sound may pass through opening 118 but also be cosmetically opaque so that there are no visible openings in the earcup cushion 112. For example, cosmetic cover 120 may be made of a continuous sheet of material that extends over the interior support member 116 and has one side or edge 206 (e.g., an outer side or edge) attached to the exterior side of the frame 102 and another side or edge 208 attached to an interior side of the frame 102 surrounding the cavity 104. As previously discussed, the cosmetic cover 120 may be made of a material that is both acoustically transparent and cosmetically opaque so that sound may pass through opening 118 under cover 120 to damping component 114 while still hiding the opening 118 so it is not visible to the user. For example, cosmetic cover 120 may be made of a textile material (e.g., a material made from interlacing fibers) that allows for the passage of sound while still hiding any underlying openings or components of cushion 112. In addition, cosmetic cover 120 may help to even the surface (contour) of the cushion 112 and prevent leakage between cushion 112 and the user. For example, in some cases, when putting the headphones on, the compression of the cushion 112 can cause creases in the underlying interior support member 116. The cosmetic cover 120 may help to even out any such creases so that the cushion 112 maintains a more consistent shape and/or seal with the user's head. In addition, since the cosmetic cover 120 is a textile material, it may have a higher friction coefficient than other materials which help it stick to the user's skin, further improving the seal.

Figure 3:
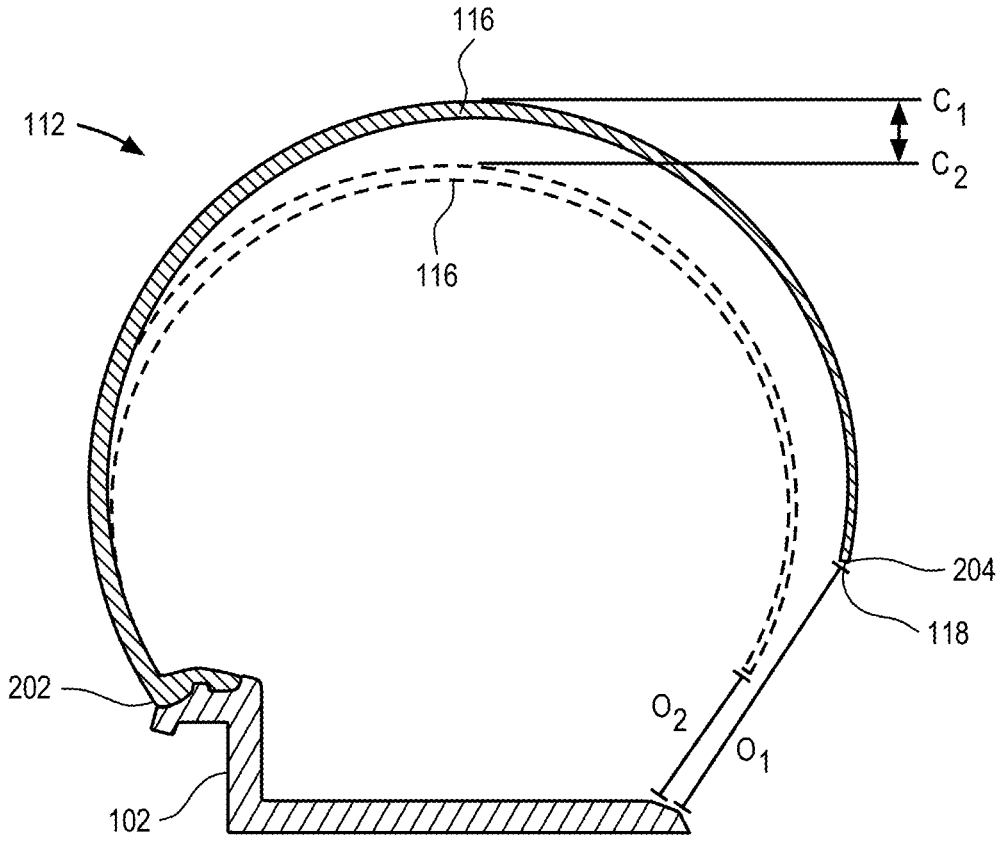
FIG. 3 illustrates a schematic diagram of a magnified cross-sectional view of the headphone earcup structure of FIG. 1.
Figure 4:
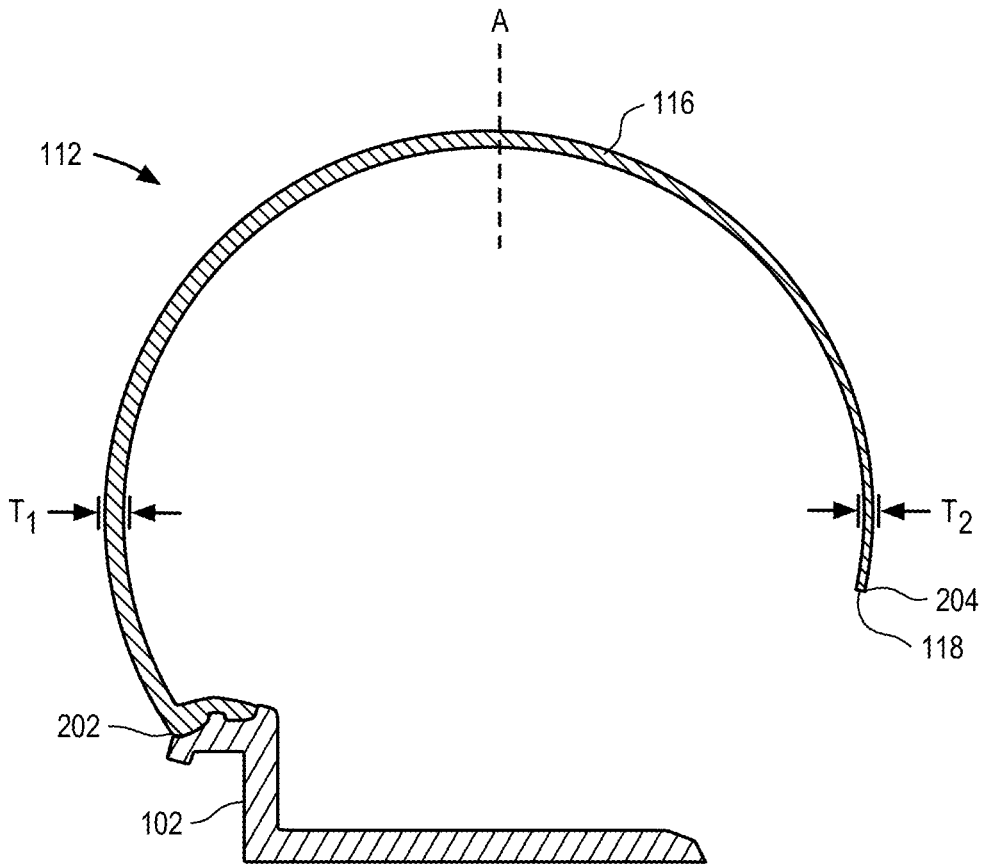
FIG. 4 illustrates a schematic diagram of a magnified cross-sectional view of the headphone earcup structure of FIG. 1.

Aspects of the interior support member 116 will now be described in more detail in reference to FIG. 3 and FIG. 4. FIG. 3 illustrates a magnified cross-sectional view of the interior support member 116 in a natural, uncompressed configuration and a compressed configuration. FIG. 4 illustrates a magnified cross-sectional view of the interior support member 116 in which the variable thickness to help control the level of compression and allow for passive attenuation can be seen. The damping component 114 and cosmetic cover 120 are omitted from these views.

Referring now to FIG. 3, from this view it can be seen that interior support member 116 has a natural, uncompressed configuration (C1), and then bends toward frame 102 to a compressed configuration (C2) (illustrated by dashed lines). This transition from the uncompressed configuration (C1) to compressed configuration (C2) may occur when the user puts on the headphones and the cushion 112 is pressed (e.g., the foam damping component is compressed) against the user's ear/head. It can therefore be understood that the interior support member 116 has some amount of flexibility to allow for compression of cushion 112. As the interior support member 116 bends toward frame 102, however, inner side or edge 204 defining opening 118 moves toward frame 102 as shown. The size and/or shape of opening 118 therefore also changes between a natural, uncompressed size/shape (01) and a compressed size/shape (02). The size/shape of opening 118 may be tuned so that in the uncompressed size/shape (01) and compressed size/shape (02) it will still remain open and allow for a minimum amount of damping under compression. In other words, even when compressed, there will still be an opening between the underlying damping element and the acoustic cavity of the earcup to allow for damping. For example, the uncompressed size/shape (01) and compressed size/shape (02) may be within a predetermined range found suitable for achieving a minimum amount of damping in both configurations. This may be achieved by, for example, having the inner side or edge 204 of interior support member 116 terminate at a particular location or distance from frame 102 as shown. In addition, the bending of the interior support member 116 may be controlled by modifying a thickness of the interior support member 116 so that it is flexible enough to bend and provide user comfort, yet still stiff enough to maintain a desired size/shape opening 118.

Representatively, referring now to FIG. 4, it can be seen from FIG. 4 that interior support member 116 has a thickness (T1) at the outer end or edge 202 and then decreases in thickness to thickness (T2) towards the inner end or edge 204. The variation in thickness may be tuned to achieve a desired level of stiffness and/or flexibility suitable to maintain opening 118. In addition, the variation in thickness may be tuned to achieve passive attenuation. For example, in some aspects, the interior support member 116 may begin to thin out past the apex (A). This configuration may help to maximize the overall bending stiffness or otherwise make the interior support member 116 less bendable. This may, in turn, help to tune or otherwise maintain the desired size/shape (01, 02) of opening 118. In addition, this configuration may help maximize passive attenuation because it maximizes the thickness of the portion of the interior support member 116 which faces the ambient environment (or away from the acoustic cavity). For example, the thickness (T1) of the portion of interior support member 116 between the apex and edge 202 may be selected such that it is thick enough to maximize passive attenuation while still allowing for some bending of interior support member 116. In other aspects, the interior support member 116 may begin to thin out before the apex (A) to minimize the bending stiffness or otherwise make the interior support member 116 more bendable. This configuration may be desired where a less stiff, or more compliant, earcup cushion is desired.

Figure 5:
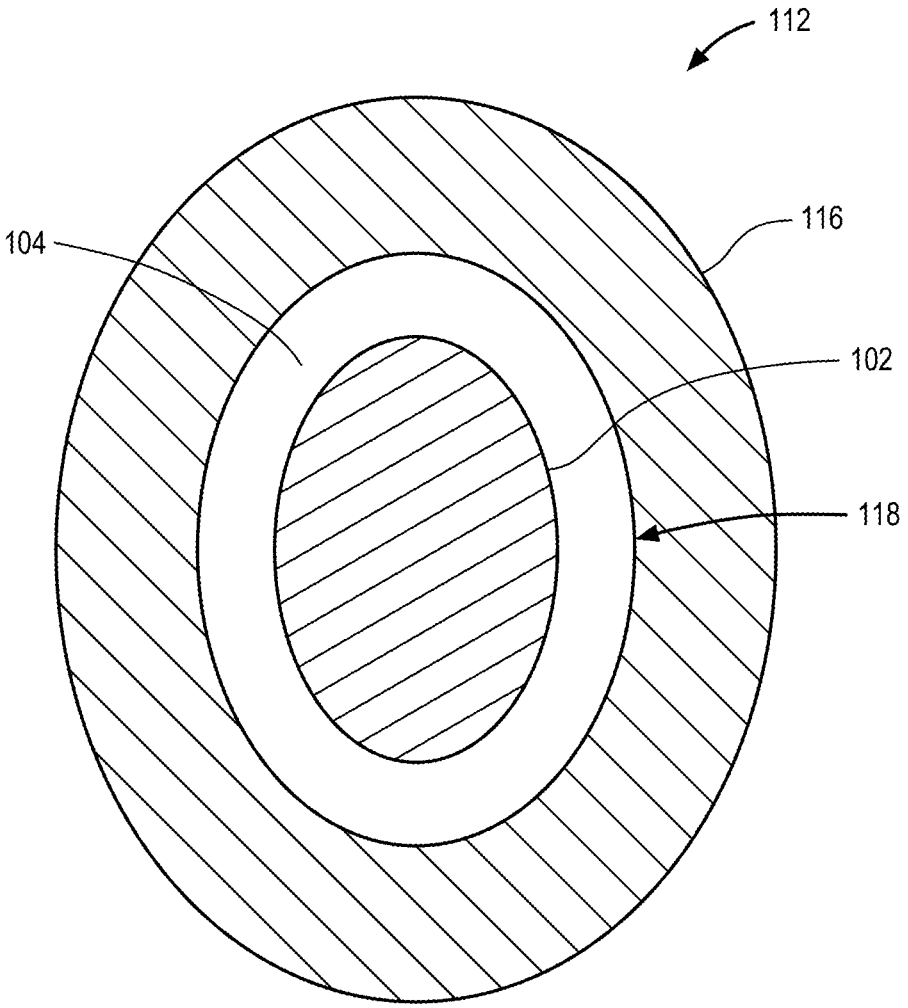
FIG. 5 is a schematic diagram of a top plan view of the headphone earcup structure of FIG. 1.

Referring now to FIG. 5, FIG. 5 illustrates that opening 118 may be a continuous opening formed around an entire perimeter of cavity 104. For example, in aspects where earcup cushion 112 is a donut shaped structure, opening 118 may be an annular opening that is formed between the end or edge of the interior support member 116 and frame 102, and completely encircles the acoustic cavity 104. It should further be understood that whether cushion 112 is uncompressed or compressed, the entire opening 118 remains open and does not close at any region around the perimeter of cavity 104. This particular location of opening 118 allows for a consistent seal against the user's head while still achieving a minimum amount of damping under compression.

Figure 6:
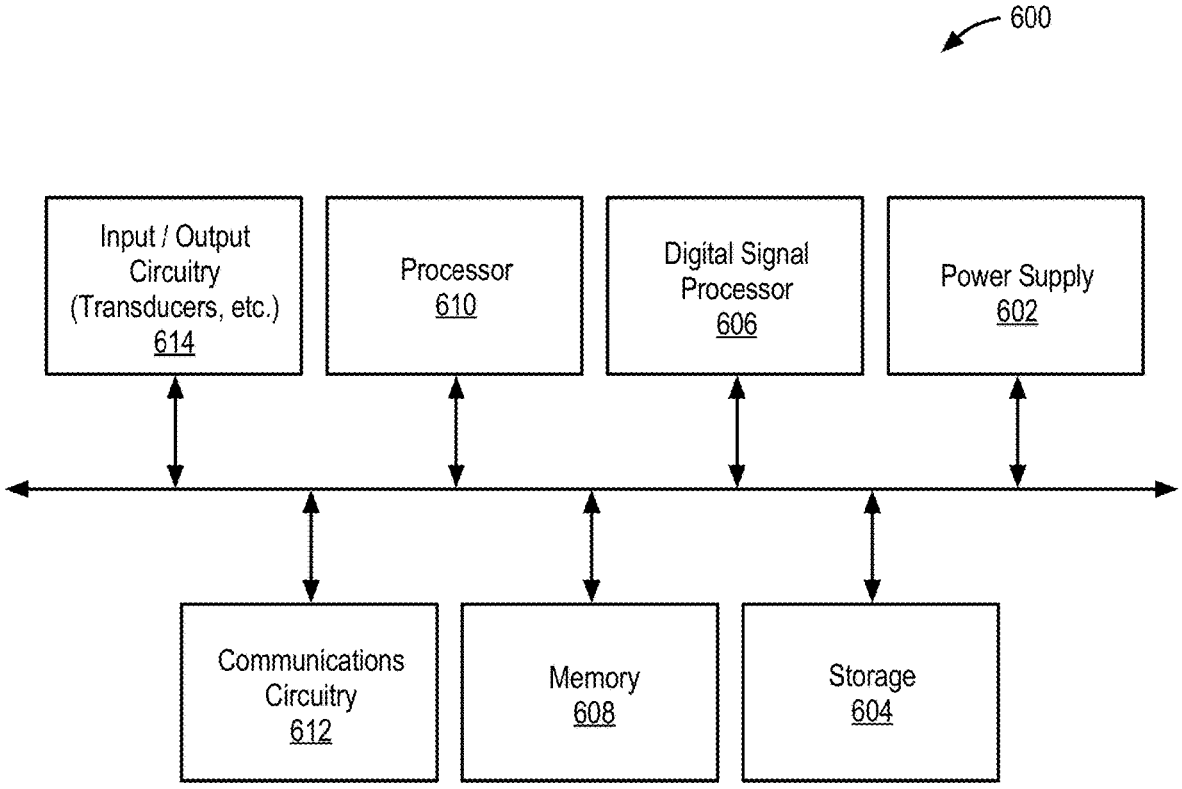
FIG. 6 illustrates a simplified schematic view of one embodiment of an electronic device in which the headphone earcup structure may be implemented.

FIG. 6 illustrates a simplified schematic view of one embodiment of an electronic device in which the headphone earcup disclosed herein may be implemented. For example, headphone 100 are examples of systems that can include some or all of the circuitry illustrated by electronic device 600.

Electronic device 600 can include, for example, power supply 602, storage 604, signal processor 606, memory 608, processor 610, communication circuitry 612, and input/output circuitry 614. In some embodiments, electronic device 600 can include more than one of each component of circuitry, but for the sake of simplicity, only one of each is shown in FIG. 6. In addition, one skilled in the art would appreciate that the functionality of certain components can be combined or omitted and that additional or less components, which are not shown in FIGS. 1-5, can be included in, for example, headphone 100.

Power supply 602 can provide power to the components of electronic device 600. In some embodiments, power supply 602 can be coupled to a power grid such as, for example, a wall outlet. In some embodiments, power supply 602 can include one or more batteries for providing power to a headphone or other type of electronic device associated with the headphone. As another example, power supply 602 can be configured to generate power from a natural source (e.g., solar power using solar cells).

Storage 604 can include, for example, a hard-drive, flash memory, cache, ROM, and/or RAM. Additionally, storage 604 can be local to and/or remote from electronic device 600. For example, storage 604 can include integrated storage medium, removable storage medium, storage space on a remote server, wireless storage medium, or any combination thereof. Furthermore, storage 604 can store data such as, for example, system data, user profile data, and any other relevant data.

Signal processor 606 can be, for example a digital signal processor, used for real-time processing of digital signals that are converted from analog signals by, for example, input/output circuitry 614. After processing of the digital signals has been completed, the digital signals could then be converted back into analog signals. For example, the signal processor 606 could be used to analyze digitized audio signals received from ambient or error microphones to determine how much of the audio signal is ambient noise or earcup noise and how much of the audio signal is, for example, music signals.

Memory 608 can include any form of temporary memory such as RAM, buffers, and/or cache. Memory 608 can also be used for storing data used to operate electronic device applications (e.g., operation system instructions).

In addition to signal processor 606, electronic device 600 can additionally contain general processor 610. Processor 610 can be capable of interpreting system instructions and processing data. For example, processor 610 can be capable of executing instructions or programs such as system applications, firmware applications, and/or any other application. Additionally, processor 610 has the capability to execute instructions in order to communicate with any or all of the components of electronic device 600. For example, processor 610 can execute instructions stored in memory 608 to enable or disable ANC, or instructions to open or close a passive control assembly valve.

Communication circuitry 612 may be any suitable communications circuitry operative to initiate a communications request, connect to a communications network, and/or to transmit communications data to one or more servers or devices within the communications network. For example, communications circuitry 612 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 614 can convert (and encode/decode, if necessary) analog signals and other signals (e.g., physical contact inputs, physical movements, analog audio signals, etc.) into digital data. Input/output circuitry 614 can also convert digital data into any other type of signal. The digital data can be provided to and received from processor 610, storage 604, memory 608, signal processor 606, or any other component of electronic device 600. Input/output circuitry 614 can be used to interface with any suitable input or output devices. Furthermore, electronic device 600 can include specialized input circuitry associated with input devices such as, for example, one or more proximity sensors, accelerometers, etc. Electronic device 600 can also include specialized output circuitry associated with output devices such as, for example, one or more speakers, earphones, etc.

Lastly, bus 616 can provide a data transfer path for transferring data to, from, or between processor 610, storage 604, memory 608, communications circuitry 612, and any other component included in electronic device 600. Although bus 616 is illustrated as a single component in FIG. 6, one skilled in the art would appreciate that electronic device 600 may include one or more components.

While certain aspects have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A headphone earcup comprising:

a frame defining a cavity dimensioned to surround an ear of a user;

a damping component coupled to the frame and encircling the cavity;

a wrap component that covers the damping component and comprises an edge spaced apart from the frame and defining a continuous acoustic opening around an entire perimeter of the cavity to acoustically connect the cavity to the damping component; and a cosmetic component that covers the wrap component and the continuous acoustic opening.

2. The headphone earcup of claim 1 wherein the wrap component comprises a variable thickness.

3. The headphone earcup of claim 1 wherein the wrap component comprises an outer edge that is over molded to the frame and an inner edge that defines the continuous acoustic opening.

4. The headphone earcup of claim 3 wherein the wrap component is thicker near the outer edge than the inner edge.

5. The headphone earcup of claim 1 wherein an entire area of the continuous acoustic opening remains open when the headphone earcup is compressed.

6. The headphone earcup of claim 1 wherein the wrap component comprises a material selected from one of a silicone, a polyurethane or a thermal polyurethane.

7. The headphone earcup of claim 1 wherein the cosmetic component comprises an acoustically transparent and cosmetically opaque material.

8. A headphone earcup comprising:

a frame defining an acoustic cavity that is acoustically coupled to a driver; and an annular cushion coupled to the frame and encircling the acoustic cavity, the annular cushion comprising a damping component and an interior support member partially covering the damping component, the interior support member having a variable thickness along a portion of the interior support member facing the acoustic cavity.

9. The headphone earcup of claim 8 wherein the variable thickness of the interior support member increases in a direction away from the acoustic cavity.

10. The headphone earcup of claim 8 wherein the interior support member defines a continuous acoustic opening between the acoustic cavity and the damping component to acoustically connect the damping component to the acoustic cavity.

11. The headphone earcup of claim 10 wherein the continuous acoustic opening is configured to remain open during compression of the annular cushion so as to maximize an acoustic damping under compression.

12. The headphone earcup of claim 8 wherein the damping component comprises a foam material and the interior support member comprises a silicone material.

13. The headphone earcup of claim 8 wherein the interior support member comprises a silicone material over molded to the frame.

14. The headphone earcup of claim 8 further comprising a cosmetic layer covering the interior support member and the damping component to form a cosmetic surface free of visible openings.

15. The headphone earcup of claim 14 wherein the cosmetic layer comprises a textile material.

16. A headphone earcup comprising:

a frame defining an acoustic cavity that is acoustically coupled to a driver; and a cushion coupled to the frame, the cushion comprising an interior support member having an outer edge coupled to the frame and an inner edge that defines a gap between the interior support member and the frame, and wherein a thickness of the interior support member decreases in a direction toward the inner edge.

17. The headphone earcup of claim 16 wherein the outer edge is overmolded to the frame.

18. The headphone earcup of claim 16 wherein the gap completely encircles the acoustic cavity.

19. The headphone earcup of claim 16 wherein the interior support member comprises an apex at a position furthest from the frame, and the thickness of the interior support member begins to decrease between the apex and the inner edge.

* * * * *